United States Patent [19]

Chalabian

[11] 4,049,106

[45] Sept. 20, 1977

[54] VENDING MACHINE MECHANISM HOUSING AND ARMOR PROTECTION THEREFOR

[75] Inventor: Jack S. Chalabian, Huntington Beach, Calif.

[73] Assignee: K-Jack Engineering Company, Inc., Gardena, Calif.

[21] Appl. No.: 687,881

[22] Filed: May 19, 1976

Related U.S. Application Data

[63] Continuation-in-part of Ser. No. 664,546, March 8, 1976, abandoned.

[51] Int. Cl.[2] ..... G07F 5/08

[52] U.S. Cl. ..... 194/1 B; 194/1 G

[58] Field of Search ..... 194/1 A, 1 B, 1 R, 97 R, 194/1 D, DIG. 15, 54, 1 G, DIG. 2; 232/58, 62

[56] References Cited

U.S. PATENT DOCUMENTS

| | | | |
|---|---|---|---|
| 771,051 | 9/1904 | Fonts | 232/62 |
| 2,087,717 | 7/1937 | Berg | 194/1 B |
| 3,503,482 | 3/1970 | Davis | 194/54 |

FOREIGN PATENT DOCUMENTS

| | | | |
|---|---|---|---|
| 1,322,328 | 7/1973 | United Kingdom | 194/1 A |
| 1,250,795 | 10/1971 | United Kingdom | 194/1 A |

*Primary Examiner*—Stanley H. Tollberg
*Attorney, Agent, or Firm*—George F. Smyth

[57] ABSTRACT

An housing for protecting a coin sorting and control mechanism and a coin storage box for use with a vending machine, such as a newspaper stand. The housing comprises a body in which a coin sorting and control mechanism may be mounted, and into which a vending machine door latch may move for cooperation with the control mechanism to lock the door in the closed position until coinage of a preselected value is inserted into the housing. A coin return chute is in the body to return rejected coins and foreign matter to the consumer. Proper coinage will fall through a funnel and past a baffle system into a coin storage box. The body is a five-sided structure enclosed by a cover which fits closely over its top. The cover encloses the sixth side of the body. The cover and body are provided with heavy steel flanges through which a padlock can be passed to lock them together. A padlock protector may be releasably fixed to the flanges by the padlock in such a manner as to prevent a bolt cutter or other device from being placed on the shackle of the packlock to cut it open.

24 Claims, 10 Drawing Figures

51
53
41
29
61
25
21
33
91
111
43
45
47
73
71
65
67
85
109
107
105
101
113
103
81
27
55
57
31
87
84
83
89
37
115
117

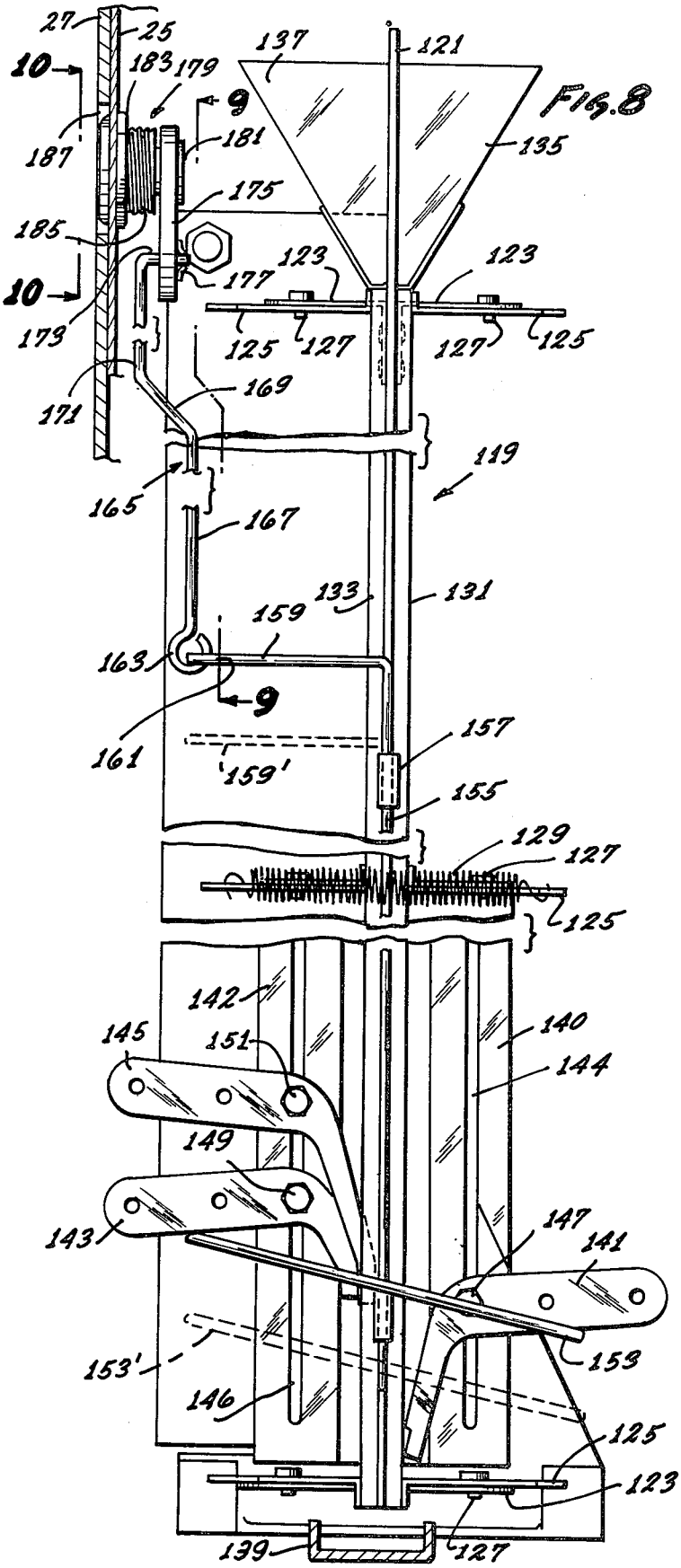
FIG. 8
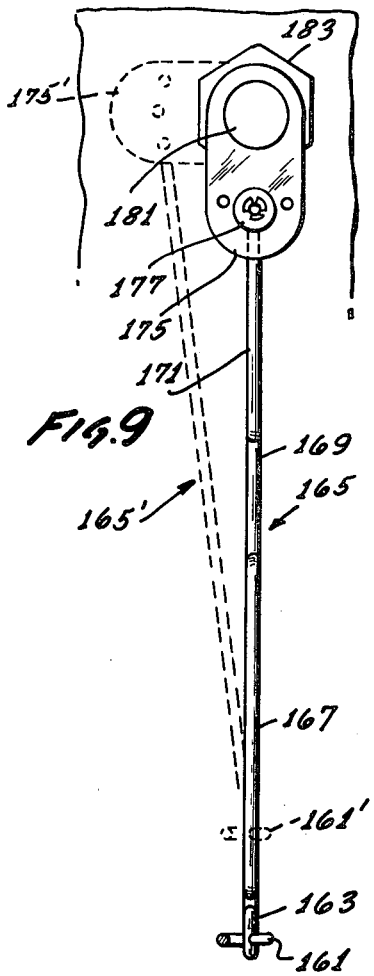
FIG. 9
FIG. 10
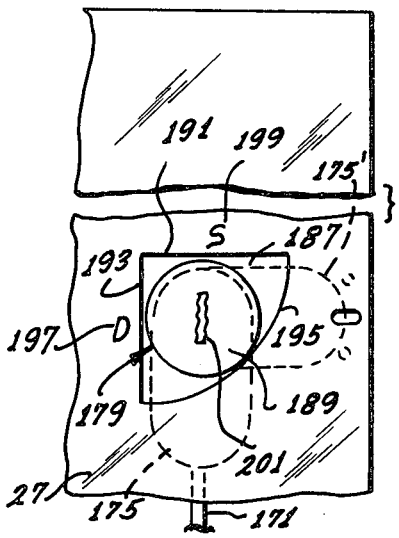

VENDING MACHINE MECHANISM HOUSING AND ARMOR PROTECTION THEREFOR

PRIOR APPLICATIONS

This application is a continuation-in-part of my prior copending application Ser. No. 664,546, filed Mar. 8, 1976, now abandoned.

BACKGROUND OF THE INVENTION

The present invention relates to the protection of a coin sorting and control mechanism such as might be used with a vending machine. Perhaps the most commonly available vending machines today are newspaper stands which are found on street corners, etc. Because these stands must be available to the public in a wide variety of locations, they are exposed not only to the weather, but also to vandalism and theft. Each time a consumer opens a machine, one or more coins must be inserted into a coin sorting and control mechanism in order to allow the machine door to be released for access to the product being sold. As a result, these machines have been subject to thievery either by full destruction of the mechanism housing or, at least, by using wire, gum, etc., to "fish" coins out of the storage box.

In some cases, thieves have employed screw drivers, pinch bars, etc., to gain access to the interior of the housing in order to steal the coins. Not only does the vendor suffer the loss of the coins, but he must also replace the damaged machine before he will again be able to sell his product at that location.

In some cases, thieves have cut open the shackle of the padlock with hand saws, bolt cutters, etc., in order to get at the coins. In such cases, the vendor loses the money which is stolen and must replace the padlock before he can sell his product again. Even when he does replace the padlock, however, it is quite likely that the same or another thief will cut the new padlock. These problems have been very difficult to overcome for several reasons. Since the amount taken in by any machine in the normal course of a day is relatively small, it is necessary that a newspaper distributor have a very large number of machines in a great number of locations in order to insure efficient income to make his efforst worthwile. Also, vending machines, such as newspaper stands, must be located in a great number of locations in order to insure maximum circulation of the newspapers. Thus, it is impossible to sufficiently guard or "stake out" all of the machines in order to apprehend the thieves and vandals. Further, even if they are apprehended, the total amount stolen and the total dollar vaue of the destruction is rarely sufficient to be considered a felony.

These machines have also been susceptible to theft of the coins when the vandals turn the machine upside down and shake it so that the coins can be taken out through the coin return chute.

Consequently, it has become necessary, and in some cases vital, to provide a device which will protect the coin sorting and control mechanism and all coins received during the normal course of vending the product from vandals and thieves. Such a structure must be strong enough to withstand attacks by all of the tools normally employed by or available to such vandals or thieves.

SUMMARY OF THE INVENTION

The present invention relates precisely to such a device and more particularly, to such a device which may be employed with a newspaper vending machine. In its presently preferred embodiment, a device formed in accordance with the present invention may be employed to protect a coin sorting and control mechanism of any type which is currently available and in use. Such a mechanism has been shown, for example, in U.S. Pat. No. 3,884,330. In that patent, a mechanism has been described and illustrated through which coins may be passed for cooperation with certain pawls to allow the machine door to be opened and access gained to a newspaper. To the door of the vending machine, a latch element may be fastened which extends to a position in which it is locked by the sorting and control mechanism. When coins of proper value are inserted into the mechanism, they fall through one or more chutes into contact with a coin seat on the latch. Then, when the operator pulls on the door to open the machine, the coins act between one or more pawls and the coin seat to move the latch into a position in which the door can be opened. The coins may then fall into a storage box for later removal by the vendor.

In the mechanism of the patent cited above, provision has been made for the rejection of coins of improper value and any foreign matter which might be inserted into the machine. That rejection mechanism has taken the form of structure which allows the coin transfer chutes to be opened so that the coins will fall out of the chute and into a coin return from which they can be retrieved by the consumer.

In order to protect mechanisms of this sort, the present invention relates to a housing which, essentially, includes a body which may be fixed to the vending machine and in which the sorting and control mechanism can be fixed. The housing also includes a cover which fits closely over the body and which may be locked thereto, for example, by a padlock.

In the presently preferred embodiment, the body may comprise an elongated, five-sided structure including an elongated front wall, two sidewalls of similar length, and a top and bottom. In other words, the back "wall" of the body is open nearly throughout the entire length thereof.

The cover may comprise a four-sided structure which closes the open rear side of the body and fits closely over the top and two sides of the body. Also, a short extension on the cover may also enclose a grip against a small upper portion of the front wall of the body. The cover may be provided with a strong plate, in the nature of a flange, which cooperates with a flange or bracket mounted on the body in such a way that the two elements receive the shackle of the padlock so that they may be locked together. In order to further protect the machine, a padlock protector may be formed to fit closely in a fixed position over the two flanges in order to allow a padlock to be installed in such a manner that it will be impossible to apply a hack saw or bolt cutter to the shackle.

With such structure, it will be impossible for vandals and thieves to open the housing or damage it to such an extent that access can be gained to its interior for removal of the coin storage box. However, when the vendor removes the cover, he gains easy access to the interior of the body for removal of the coins, alteration of the mechanism, etc.

As stated previously, a door latch passes into the housing in some machines for cooperation with the control mechanism and, consequently, a small opening must be made in the front wall of the body. In the past, thieves have inserted wire and similar devices, with gum or some adhesive element attached, in order to fish coins out of the housing. In the presently preferred embodiment, a baffle system may be employed in the housing and/or coin box between the control mechanism and the location in which coins are stored, which will totally prevent such thievery.

In the present invention, one of the baffle elements may be hingedly mounted in such a way that it will seal itself against another baffle element if the machine should be overturned. In this manner, structure is provided to positively prohibit removal of the coins in the box if the machine is turned upside down and shaken.

As a result of these and additional features which will be described, vandals and thieves will be substantialy prohibited from gaining access to the interior of the housing through the use of normally available tools and weapons. Upon perusal of the following detailed description, together with the accompanying drawings, those skilled in the art will become aware of additional advantages and objects of the invention, as well as of further embodiments which employ its teachings.

BRIEF DESCRIPTION OF THE DRAWINGS

FIG. 8 is a partial rear elevational view of the coin sorting and control mechanism with the surrounding housing in which the sorting and control mechanism may be controlled by a key inserted through an aperture in the housing;

FIG. 9 is a partial elevational view which illustrates an eccentric that is rotatable by a key with the rotational movement of the eccentric being converted to linear movement through a connecting linkage in controlling the sorting and control mechanism, and FIG. 10 is a detail view taken along line 10—10 of FIG. 8 of a key opening in the protective housing having indicia thereon to indicate the key position in terms of the setting for the coin sorting and control mechanism.

DETAILED DESCRIPTION

Figure 1:
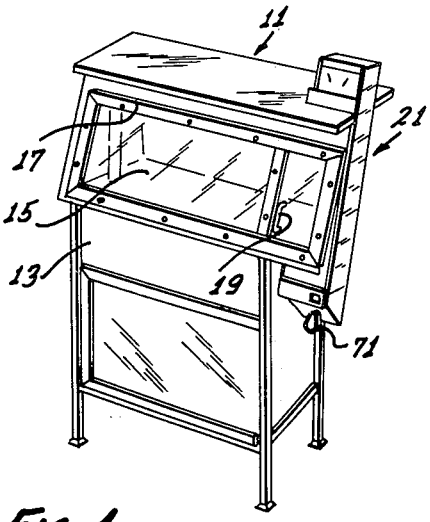
FIG. 1 comprises an isometric illustration of a newspaper vending machine which may employ a housing formed in accordance with the present invention.

There is shown in FIG. 1 a newspaper vending machine, generally designated 11, including a main housing 13 into which newspapers may be installed. Access to the housing may be gained via a door 15 which may be hinged along a line 17 and opened by a consumer when he pulls upon a handle 19 fixed to the door, after inserting proper coinage into the machine. There is shown, attached to the machine 11, a housing 21 into which suitable coinage may be inserted by the consumer which will release an actuating lever (not shown) and allow the door to be opened.

It should be realized that the machine illustrated in FIG. 1 is considered to be exemplary only and that the present invention can be employed with any similar machine in which it is desired to protect certain structure which must be operated by the public.

Figure 2:
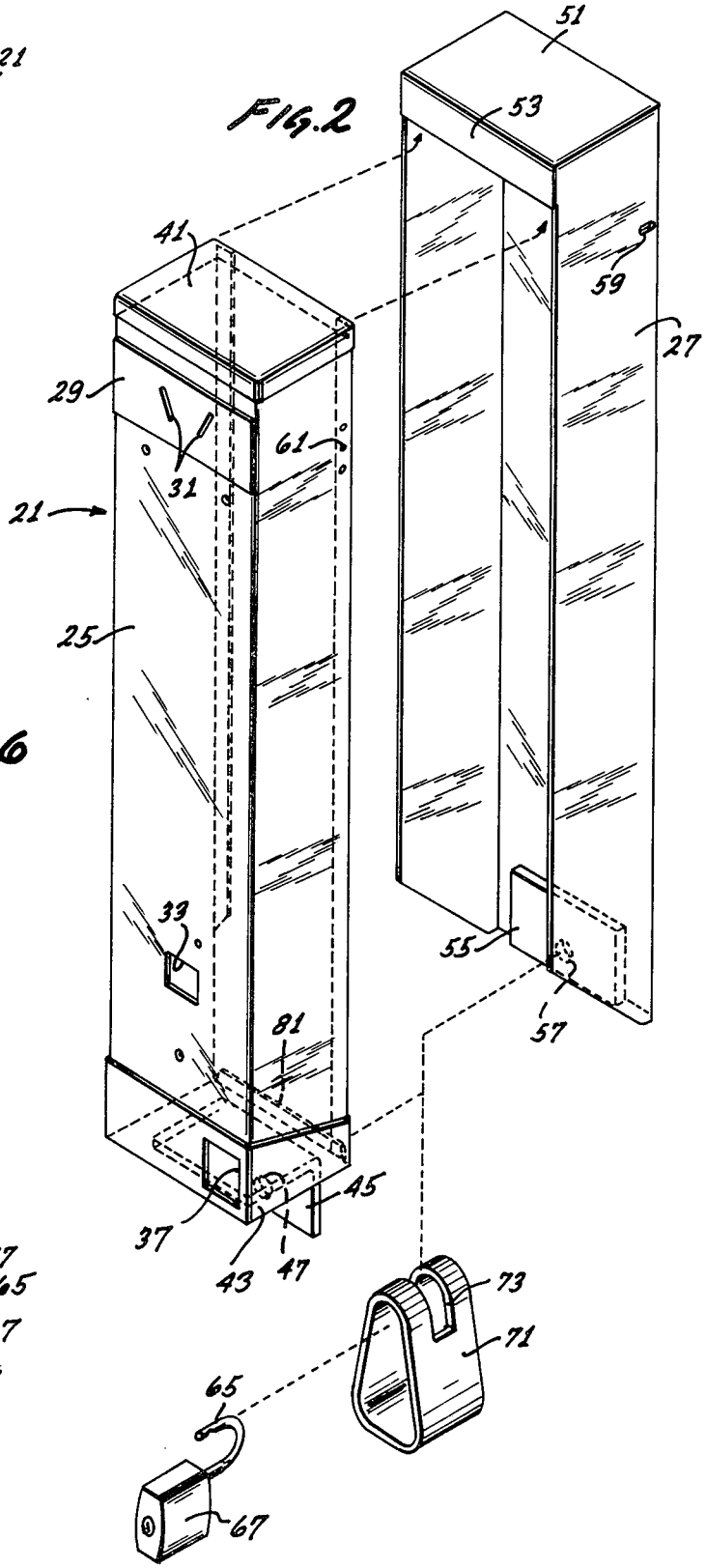
FIG. 2 is an exploded isometric illustration of the elements forming the housing which may be used to protect a coin sorting and control mechanism.

As shown in FIG. 2, the housing 21 may comprise a body 25 and a cover 27. To the body 25, a face plate 29 may be attached having slots 31 into which a consumer may push coins of certain values. Coins pushed into a slot 31 may cooperate with any desired sorting and control apparatus in order to prohibit opening of the door unless the value of the inserted coins is correct. Such a sorting and control apparatus has been illustrated and described in the above-discussed U.S. Pat. No. 3,884,330 and the teachings thereof are herewith incorporated by reference, insofar as is necessary. As disclosed in that patent, a locking bar or latch may be mounted on the inner surface of the door 15 of the machine so as to extend into the housing 21 when the door is closed.

Preferably, the latch, not shown, may extend through an opening 33 in the body 25 so as to be locked by the sorting and control structure until proper coinage has been pushed through the slot 31. If desired, a second opening 37 may be suitably located in the body 25 so that coins of improper value, foreign matter, etc., can be returned to the consumer if it has been rejected by the coin sorting and a control structure.

The body 25 may comprise a three-sided structure enclosed by a cap or top plate 41 and a bottom plate 43. As shown, the plates 41 and 43 may enclose portions of the front and sides of the body in the manner illustrated in order to strengthen them and rigidify the structure. An L-shaped bracket 45 may be welded or otherwise attached to the bottom plate 43 to present a downwardly extending flange hving a circular opening 47 therein for a purpose to be described. The rear "wal" or side of the body may be open for nearly the entire width thereof, although, if desired, the sides and the plates 41 and 43 may be bent to form small, strengthening flanges, as illustrated by hidden lines in FIG. 2.

The cover 27 may also comprise a three-sided structure, the top of which is enclosed by a cap plate 51 having a downwardly extending flange 53 to partially enclose the front side of the body. For the sake of convenience, the open side of the body 25 will be referred to as being at the rear of the body (and thus shown in hidden line form in FIG. 2), and the open side of the cover 27 may be considered to be the front of the cover.

There may be attached, to the rear of the cover, a metal plate 55, having an opening 57 therein. Also, the side walls of the cover may extend below the sides of the body, when the cover is located on the body. The advantages of these features will be discussed below.

The body 25 may be suitably fixed to the machine 11 so as to be immobilized relative thereto and, if desired, tilted from horizontal as illustrated in FIG. 1. As described in U.s. Pat. No. 3,884,330, this inclination will allow rejected coins and foreign matter to fall toward the rear of the housing 21. This will allow the rejected material to be delivered to the coin return opening 37 in a manner to be hereinafter described.

In any event, the cover 27 is normally positioned over the body 25 in such a manner that the top cap 51 covers the cap 41 of the body so that the flange 53 extends down the front of the body almost into contact with the base plate 29. This will not only protect the top of the body, but also will prevent the cover from being pulled away from the body toward the rear of the machine.

If desired, an aperture 59 may be formed in one side wall of the cover 27 so as to be coaxially located with an aperture 61 in the adjacent sidewall of the body 25 when the cover is positioned over the body. By this means, the machine owner is able to adjust a coin mechanism such as that described in the above-cited patent from daily to Sunday operation and vice-versa, without opening the housing 21.

In any event, when the cover is placed over the body, the plate 55 on the rear wall of the cover will abut the bracket 45 on the bottom of the body so that the apertures 47 and 57 are coaxially aligned. Then, the shackle 65 of a padlock 67 may be inserted through the apertures 47 and 57 and the padlock closed to prevent separation of the cover from the body 25. Thus, the flange 53 and the padlock cooperate to prevent any relative movement between the cover and the body. In this manner, the cover will provide substantial protection to the body, while enclosing the rear side thereof to prevent unauthorized access to the inside of the body.

In order to prevent a vandal or thief from attacking the padlock by cutting or breaking the shackle 25, a protector 71 may be provided having a closed, generally triangular configuration, as depicted in FIG. 2. A slot 73 may be formed in the protector 71 in the illustrated configuration. Preferably, the opposite ends of the slot, in the opposed sidewalls of the protector 71, may be flat and the slot may be wide enough to extend over the bracket 45, the plate 55, and the rear wall of the cover 27 in the manner illustrated in FIG. 3. Thus, the flat ends of the slot 73 will cooperate with the lower edges of the bracket 45 and plate 55 to prevent relative movement therebetween.

Figure 3:
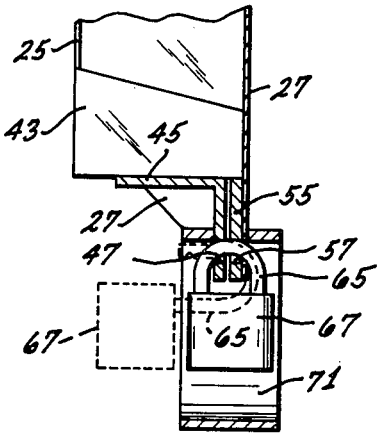
FIG. 3 comprises a partial side view of the housing, illustrating the manner in which a padlock may be protected.

When the protector 71 is positioned over the apertures 47 and 57, the padlock 67 may be installed or removed in the manner illustrated in FIG. 3. However, when the padlock is locked, it will be impossible for an unauthorized person to attack it with any readily available tools, such as a hack saw or bolt cutter, because the protector 71 will completely cover that portion of the shackle not housed within the body of the padlock. Also, the lower extensions of the cover sides will cooperate with one another and the protector 71 to severely restrict access to the padlock with such tools.

Figure 6:
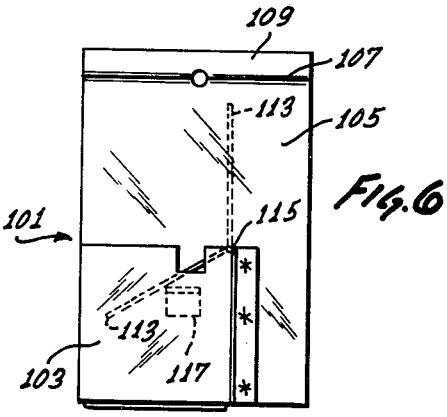
FIG. 6 comprises an elevation view of the coin storage box.
Figures 4, 5, 7:
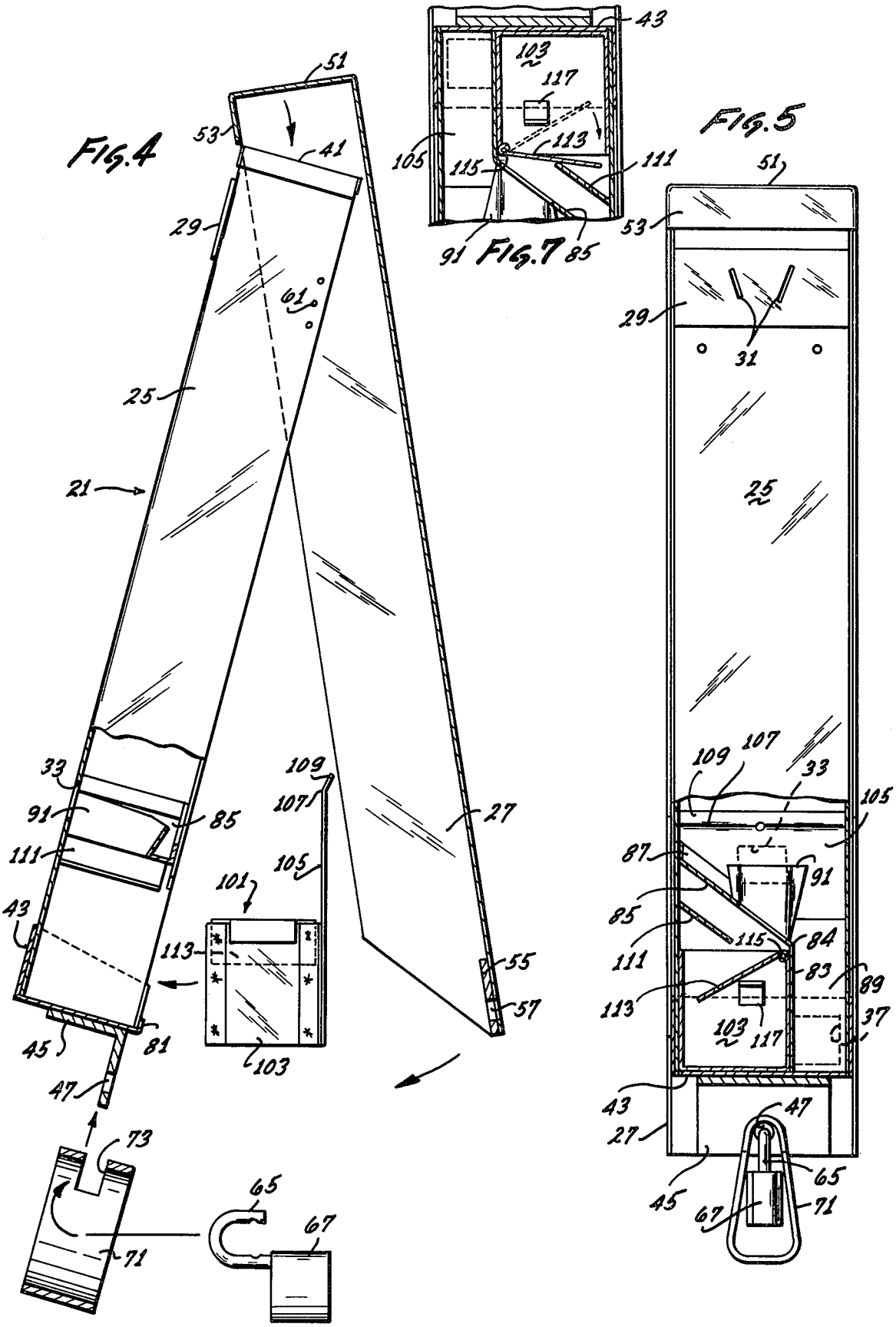
FIG. 4 is a side elevation of the housing, depicting the manner in which the coin box may be inserted into the housing and in which the cover may be installed to be locked to the body.
FIG. 5 is a front elevation of the housing, partially broken away, to illustrate the relationships of certain portions of the housing interior.
FIG. 7 comprises a partial elevation of the housing and coin storage box, upside down, to depict the operation of the baffle sealing feature of the invention.

Turning now to FIGS. 4–6, it can be seen that the bottom plate 43 of body 25 may be provided with an upright flange 81 as previously suggested. The flange 81, acting together with the front and two sides of the housing 25, may form a cup-like section which is open at the rear of the housing.

As illustrated in FIG. 5, an upright partition 83 may be formed in the housing extending from the front to the rear thereof. At approximately the position illustrated at the number 84 in FIG. 5, the partition 83 may change direction and extend toward one side of the housing, forming a sloped surface 85. At the rear of the body, an upright flange 87 may be formed integral with the surface 85 for a purpose to be described.

Similarly, at the rear of the body 25, there may be formed, integral with or attached to the partition 83, a cross partition 89 which extends to a position slightly above the bend 84 in the partition 83, 85. Suitably fixed in the partition, and particularly in the angled surface 85, may be a funnel-like structure 91. Preferably, the funnel structure 91 may be located immediately below the chutes of the coin sorting and control mechanism so that, when proper coinage is in the chutes, the door may be opened in a well-known manner and the coins dropped into the funnel.

As illustrated in these figures, a coin storage box 101 may be provided which will fit into the volume formed between the upright partition 83 and the opposite wall of the body 25. Preferably, the coin storage box will comprise a box-like section 103 which is open at the upper limit thereof; the remaining five sides of the box 103 are completely closed. The back or rear portion of the box may be closed by a plate 105 which may be sufficiently wide to extend completely across the open rear area of the body 25.

As illustrated particularly in FIG. 4, a bend 107 is formed in the plate 105 near the upper edge thereof to form an extension 109 which, when the coin box 101 is seated within the body, extends slightly beyond the rear edge of the body. Thus, when cover 27 is positioned on the body, the rear surface of the cover will very closely abut the upper extension 109, creating a very tight fit therebetween. Consequently, if incorrect coinage or foreign matter should be inserted into the housing through the slots 31, when the chutes are opened to reject such materials, they will fall against the rear wall of the cover due to its inclination, and travel downwardly until they contact the inner surface of the plate 105. At that point, the will continue to fall, being guided both by the plate 105 as well as by the sloped or slanted surface 85, causing the material to fall into the coin return for access from the front of the machine through the opening 37.

In other words, the inner surface of the rear cover wall, the plate extension 109, the surface of plate 105, the flange 87, and sloped surface 85 cooperate to direct all rejected matter to the coin return and all correct coinage to drop through the funnel 91.

In the past, it has been found that some vandals and petty thieves could employ a wire, having gum or some adhesive substance attached thereto, to steal coins from the machine. The thief would open the machine, in the normal way, and then pass the wire and adhesive into the coin box through the opening 33 in the front of the body. In other words, the wire would pass through the opening 33 and the funnel 91 so that coins could be taken from the box 103. In order to prevent this from happening, it has been found that a baffle system may be employed, comprising a first plate 111 which may be fixed within the body and a second plate 113 which may be either fastened to the upright partition 83, for example, or formed as an integral part of the box 103. As illustrated, the plate 113 is pivotally mounted on the plate 83 by means of a hinge 115, allowing plate 113 to be freely movable between the positions illustrated in FIG. 6.

Since in order to bypass the baffle surface 111 and 113, a wire would have to be very flexible if it were to reach the bottom of the coin box to gain access to the coins, the wire would not be able to withstand the necessary axial pressure to affix a coin to the gum or adhesive. On the other hand, if the wire is rigid enough to withstand the axial pressure, the baffle system will merely cause the wire to move against the sidewall of the coin box 103 and no coins can be stolen. Further, even if it were possible to reach the coins, as the wire is pulled back through the opening 33, the coins, and probably the gum, would be stripped from the wire by the leading edges of the baffle plates. Thus, the plates 111 and 113 will allow coins to fall into the box, but will prevent them from being withdrawn from it.

As stated previously, plate 113 may be either fixed or pivotally mounted on the element 83. If it is previously mounted, a flange-like stop element 117 may be provided within the box section 103 to limit the lower position of the baffle plate 113.

If baffle plate 113 is fixed, when the machine is turned upside down and shaken, coins in the box section 103 can move past the free edges of baffle plates 113 and 111, through the funnel 91, and into the coin return slot. On the other hand, if plate 113 can pivot about hinge 115, when the machine is overturned, plate 113 will pivot into contact with the free edge of plate 111 as illustrated in FIG. 7. Consequently, the mouth of the box section 103 will be sealed off and no coins will be able to escape through the funnel. When the machine is uprighted, the baffle plate 113 will again fall into contact with flange 117 and allow normal operation of the machine.

FIG. 8 is a partial rear elevational view of a coin mechanism 119 of the type generally described in my prior U.S. Pat. No. 3,884,330. As indicated, the coin mechanism 119 may include a main wall portion 121 which may be affixed to the front wall of the body 25 (see FIGS. 2 and 4) at substantially right angles thereto. A plurality of brackets 123 may then be connected in any suitable manner to the main wall portion 121, such as by welding or the use of rivets. Brackets 125 are then rotatably connected to the brackets 123 about interconnecting pivots 127. A coil spring 129 may then be connected between the outer ends of the rotatable brackets 125 while the inner ends of the rotatable brackets are each affixed to a coin chute 131 or to a coin chute 133. Under the influence of the coil spring 129, the coin chutes 131 and 133 are, thus, pressed against the main wall portion 121.

Each of the coin chutes 131 and 133 is made up of three sides with a fourth side being supplied by the surface of the main wall portion 121 which is contacted by the coin chutes. A funnel 135 may be secured to the coin chute 131 at its upper end while a funnel 137 may be similarly secured to the coin chute 133. The funnels 135 and 137 are similar in construction to the coin chutes 131 and 133 in that the inner surface of the funnels may be supplied by the surface of the main wall portion 121 which is contacted by the funnel. A latch 139 is positioned adjacent the lower ends of the coin chutes 131 and 133. Coins which are deposited in funnels 135 or 137 are, thus, conveyed through the respective coin chutes 131 or 133 into contact with the latch 139. The coins within coin chutes 131 and 133 are supported in edge-to-edge aligned relation within the chutes with the bottommost coin in a chute in contact with the latch 139.

As described in my prior U.S. Pat. No. 3,884,330, the latch 139 may be connected at one end to a door for a vending machine, such as the door 15 which is shown in FIG. 1. Additionally, the latch 139 may include a hook which engages a keeper when the door of the vending machine is in a locked condition (not shown). To open the vending machine, a predetermined number and/or combination of coins may be inserted into the coin chutes 131 and 133 through coin slots (such as the slots 31 shown in FIG. 2) which transmit the coins to the funnels 135 and 137 and then to the coin chutes.

A plurality of pawls indicated as 141, 143 and 145 may be rotatably positioned on locating panels 140 and 142 which may be secured in any suitable manner to the main wall portion 121. As shown, the pawls 141, 143 and 145 are adjustably positioned relative to the locating panels 140 and 142 within slots 144 and 146. Pivot bolts 147, 149 and 151 may extend into the slots 144 and 146 with nuts or any similar fastening means (not shown) being used to secure the pivot bolts with respect to the slots.

As illustrated, the pawls 141, 143 and 145 each have outer ends which are relatively heavy and which act as counterweights in exerting a turning force on each of the pawls which moves inner fingers on each of the pawls into contact with one of the chutes 131 or 133. Each of the chutes 131 and 133 may contain slots therein which are positioned to receive the fingers of the pawls positioned relative to the chutes such that the fingers of the pawls extend into one or both of the coin chutes. As coins are introduced into the chutes 131 and 133, the weight of the coin may be sufficient to rotate a pawl which is contacted by the coin as the coin encounters the pawl finger which extends into the chute. This may, then, force the pawl finger to withdraw a sufficient distance from the chute to permit the coin to pass by the pawl finger with the counterweighted outer end of the pawl again moving the pawl finger back into the chute after passage of the coin.

When a predetermined number of coins of predetermined denomination are inserted into the chute or chutes 131 and 133, the coins in a given chute are positioned in aligned edge-to-edge relation with the bottommost coin resting on the latch 139 and the uppermost coin positioned in close proximity to the finger of a pawl which extends inwardly into the chute. The position of the pawl finger relative to the uppermost coin in the stack of coins within the chute or chutes 131 and 133 may prevent upward movement of the coins within the chute such that the stack of coins may act as a column in exerting a force against the latch 139.

As discussed, one end of the latch 139 may be secured to a door for a vending machine with the latch having a hook which engages a fixed keeper when the door is in a locked condition. However, when the correct number and denomination of coins have been inserted into the chute or chutes 131 and 133, the coins, acting as a column, may exert a downward force against an upwardly raised portion on the latch 139 as the latch is moved relative to the stack of coins. This downward force may move the latch 139 so as to disengage the hook on the latch from the fixed keeper such that the door for the vending machine is permitted to open. On opening of the door, the coins within the chute or chutes 131 and 133 may then be permitted to drop into the coin box, such as box 101 shown in FIG. 6.

As described previously, the positions of the various pawls 141, 143 and 145 may be varied by adjusting the positions of the pivot bolts 147, 149 and 151 relative to the locating panels 140 and 142. In this manner, the height of the pawls 141, 143 and 145 may be set to accommodate a given height of coins positioned in edge-to-edge aligned relation within one or both of the chutes 131 and 133. Such adjustment permits the coin mechanism 119 to be varied over a wide range in the number and denomination of the coins which must be received by the coin mechanism before the latch 139 can be opened.

As an additional means of controlling the coin mechanism 119, a U-shaped cross rod 153 may be raised or lowered through movement of a control rod 155 to deactivate one or more of the pawls 141, 143 and 145. As shown in solid line drawing, the U-shaped cross rod 153 may contact the pawls 141 and 143 to rotate the pawl fingers away from the chutes 131 and 133. The pawls 141 and 143 have then been deactivated since the pawls may no longer perform a function in controlling the number and denomination of coins required to open the latch 139. With cross rod in a lowered position 153', as shown in phantom line drawing, the cross rod may be moved out of contact with the pawls 141 and 143 which are, thus, activated such that the fingers of the pawls may extend inwardly into the chutes 131 and 133.

Additionally, of course, control of the coin mechanism 119 may be provided by the size of the coin chutes 131 and 137. For example, coin chute 131 may be sized to only accept nickels and quarters while the coin chute 133 may be sized to only accept dimes. As stated, the fingers of the pawls, such as the pawls 141, 143 or 145, may extend into both of the coin chutes 131 and 133. This may be accomplished by having a slot in the main wall portion 121 which interconnects the chutes 131 and 133 such that the finger of a pawl may extend through into one of the chutes 131 or 133 and may then extend into the other of the coin chutes through the slot in the main wall portion. In this manner, the finger of a single pawl may control the opening of the coin mechanism 119 by requiring, for example, that a given number of dimes and nickels be inserted in the chutes 131 and 133 in order to operate the coin mechanism.

The use of the U-shaped cross rod 153 in controlling the coin mechanism 119 is quite advantageous when the coin mechanism has two alternate modes of operation. For example, the cross rod 153 may be moved out of contact with the pawls 141 and 143 for one mode of operation which requires that these pawls be activated and then moved into contact with pawls 141 and 143 for a second mode of operation which requires deactivation of these pawls. By way of example, in the vending of newspapers, the cost of a Sunday paper may be considerably more than the cost of a daily paper. Thus, the cross rod 153 may be used to shift the mode of operation of the coin mechanism 119 between the vending of daily newspapers and the vending of Sunday newspapers. In vending daily newspapers, the coin mechanism 119 may be controlled to open the latch 139 on the insertion of either a dime and a nickel or three nickels into the coin chutes 131 and 133. On movement of the cross rod 153, the mode of operation of the coin mechanism 119 may then be shifted for vending Sunday newspapers such that the latch 139 will open on the insertion of three dimes and a nickel, a quarter and a dime, or seven nickels into the chutes 131 and 133.

In the acceptance of multiple coin combinations by the coin mechanism 119, several pawls may be vertically positioned with the pawls extending into the same coin chute. The lower pawl may, for example, be positioned to contact the upper edge of a single quarter inserted into the chute while the upper pawl may be positioned to contact the edge of the uppermost nickel in a seven-nickel stack. When seven nickels are inserted into the coin chute, the stack of nickels may deactivate the lower pawl by forcing the pawl finger out of the chute.

In controlling the mode of operation of the coin mechanism 119 through the position of the cross rod 153, it is important that the cross rod be accurately positioned relative to the pawls, such as pawls 141, 143 and 145. Accordingly, it is important that the control rod 155 undergo a linear movement and that the control rod be relatively straight such that its movement accurately determines the position of cross rod 153.

In providing for accuracy in the movement of control rod 155, the control rod may be positioned within rod guides 157 which are fixedly secured to the main wall portion 121. The upper end of the control rod 155 may then form a bent portion 159 which terminates in a loop 161. The loop 161 may loosely engage a loop 163 of a control rod or link member 165 having a straight portion 167, an angled or bent portion 169, and a straight portion 171. The straight portion 171 may then terminate in a hook 173 which may be rotatably connected to a pivotal eccentric member 175. As indicated, the hook 173 may pass through an aperture in the eccentric member 175 which is displaced from the axis of rotation of the eccentric member with the hook being retained within the aperture by a retainer clip 177 which engages the outer end of the hook that protrudes through the aperture.

The pivotal eccentric member 175 may be connected to a lock 179 having a rotatable shaft 181 on which the eccentric member is supported. The lock 179 may extend through an aperture in the body 25 with the lock being secured to the body by a nut 183 which engages a threaded shank 185. To provide access to the lock 179, a key opening 187 may be formed in the cover 27 such that the lock may be readily accessible in shifting the mode of operation of the coin mechanism 119 as, for example, between the vending of daily newspapers and the vending of Sunday newspapers.

As described, the rotational position of the eccentric member 175 acting through the control rod or link member 165 may be transmitted directly to the control rod 155 to precisely vary the linear position of the control rod 155 and the vertical position of the cross rod 153 attached thereto. During rotation of the eccentric member 175, the control rod or link 165 will undergo a variation in its angular position. However, because of the loose joint formed between the control rod or link 165 and the control rod 155 through loops 163 and 161, the angular movement of the rod 165 is not transmitted to rod 155. Rather, only a linear component of movement of the rod 165 is transmitted to the rod 155 such that rod 155 maintains a linear movement in controlling the position of the cross rod 153.

On downward movement of the control rod 155 as, for example, in moving the cross rod to the position indicated 153', the bent portion of the control rod may move downwardly to the position indicated as 159'. During this movement of control rod 155, the angular position of the control rod or link 165 will undergo variation but this variation in angular position is not transmitted to the control rod 155. Thus, the linearity of control rod 155, both in terms of its shape and its movement, it not disturbed by the rotation of the eccentric member 175 or by the accompanying change in the angular position of the control rod 165. This, then, ensures that the cross rod 153 is accurately positioned in controlling the mode of operation of the coin mechanism 119.

As described in detail in my U.S. Pat. No. 3,884,330, the housing 21, as shown in FIG. 1, may be mounted at an angle from the vertical such that rejected coins fall to the back of the housing to be transmitted to the second opening 37 (see FIG. 2) which serves as the coin return. When an incorrect number of coins or an incorrect combination of coins are inserted into the coin chutes 131 and 133, the coins will not act as a column, as described, in asserting a force against the latch 139. Thus, the coins within the chutes 131 and 133 will, then, be free to move upwardly within the chutes on contact of the lowermost coin or coins with an upwardly raised portion of the latch 139 during movement of the latch with respect to the coin chutes. Since the coins within the chute or chutes do not act as a column in exerting a downward force against the latch 139, a hook or hooks formed on the latch member may, then, engage the fixed keeper member which may include levers thereon which are connected to the chutes 131 and 133 to rotate the chutes and funnels 135 and 137 out of engagement with the main wall portion 121. As this occurs, any coins within chutes 131 and 133 or funnels 135 and 137 may be permitted to fall downwardly against the back of the housing 21 (see FIG. 1) from which the rejected coins are then conveyed to the coin return opening. During movement of the chutes 131 and 133 and funnels 135 and 137 away from the main wall portion 121, the door for the vending machine may remain locked through the contact of the hook or hooks on the latch 139 with the fixed keeper. Also, after the coins have been released from the chutes 131 and 133 or from the funnels 135 and 137, the chutes and funnels are then returned into contact with the main wall portion 121 through the influence of the coil springs 129 which interconnect the rotatable brackets 125.

FIG. 9, which is a partial sectional view taken along line 9—9 of FIG. 8, illustrates the change in the angular position of the control rod or link 165 during rotation of the eccentric member 175 about the axis of the rotatable shaft 181. As indicated, with the eccentric member positioned in a downward direction indicated in solid line drawing as 175, the control rod 165 may be positioned vertically. However, on rotation of the eccentric member 175 to the position indicated in phantom line drawing as 175', the control rod or link undergoes a change in its position to assume the angled position indicated as 165'. The change in the angular position of the rod in its movement from position 165 to position 165' is not transmitted to the control rod 155 which experiences only a linear movement. This result is provided, as described, by the loose connection between loops 161 and 163 such that only vertical linear movement is transmitted from the rod or link 165 to the control rod 155.

FIG. 10 is a view taken along line 10—10 of FIG. 8 which illustrates in greater detail the configuration of the key opening 187 in the cover 27. As illustrated, the lock 179 may include a lock face 189 which projects into the key opening 187. The key opening 187 may include a flat side 191 which may be joined at approximately a right angle to a flat side 193. Additionally, a curved or arcuate side 195 may form the remainder of the key opening 187 such that the lock face 189 is in close proximity to the sides of the key opening. The close proximity of the sides of the key opening 187 to the lock face 189 is advantageous in making it difficult for a vandal or thief to tamper with the lock 179 by the insertion of a tool or pry member between the lock face 189 and the sides of the key opening 187.

Additionally, as shown, indicia 197 and 199 may be placed along the flat sides 191 and 193 of the key opening 187. The indicia 197 and 199 may, as indicated, be letters such as "D" and "S" which may indicate daily and Sunday for a newspaper vending machine having two modes of operation for vending daily newspapers and vending Sunday newspapers. Additionally, the indicia 197 and 199 may be positioned with respect to the lock 179 such that a key slot 201 in the lock face 189 is aligned with either one or the other of the indicia. As indicated, with the key slot 201 facing toward indicia 199, the coin mechanism 119 may be in the Sunday vending mode while with the key slot directed toward indicia 197, the coin mechanism may be in the daily vending mode. In addition to providing a means for locking the control for the coin mechanism 119, the arrangement shown in FIG. 10 may, thus, additionally provide a convenient means by which the vending machine owner can readily determine whether the mechanism is set for the desired mode of operation.

Thus, it can be seen that the present invention provides a structure which vastly improves the security of both the coin sorting and control mechanism and the coin storage structure, and which may be utilized with a vending machine of any type. Those skilled in the art will now realize the many other advantages of this invention and will also become aware of various additional embodiments of the invention, many of which may not even appear similar to that preferred embodiment described above but which, nevertheless, employ the invention.

I claim:

1. A coin mechanism housing comprising a body having means for mounting said body to a vending machine, means for receiving coins of various combinations inserted by a consumer for delivery to a coin selection and control mechanism, means for storing coins of predetermined value passed through a coin selection and control mechanism in said body, means for returning coins of other than predetermined value and which have been rejected by a coin selection and control mechanism to a consumer who has inserted them into said receiving means, means for delivering the coins inserted into said receiving means to one of said storing means and said returning means, baffle means through which coins must pass, intermediate said delivery means and said storing means, a key-operated locking mechanism on said body which is operable to alter the operating mode of a coin selection and control mechanism within said body, and indicia placed on the exterior of said body with the position of the indicia relative to the locking mechanism indicating the operating mode of the coin selection and control mechanism.

2. The housing of claim 1 including cover means selectively positionable upon said body including means for releasably fastening said cover means to said body, said body means further including means for releasably fastening said cover means to said body, and protector means operatively positionable in fixed relationship to both said releasable fastening means, so shaped as to fit in close spacing to a padlock shackled to said fastening means.

3. A coin mechanism housing comprising
a body having
a plurality of substantially closed sides,
a closed top,
a closed bottom,
an open side between said top and bottom and between two of said substantially closed sides, and
bracket means forming a flange with a shackle-receiving aperture therein extending from said body,
a cover having
a plurality of substantially closed sides, each longer than said closed sides of said body,
a closed top,
an open bottom,
an open side between said top and bottom and between two of said substantially closed sides,
flange means extending into said open side of said cover from said closed top thereof for preventing relative movement between said cover and said body when the former is installed upon the latter, and
plate means fixed to one of said closed sides of said cover near said bottom and providing
a shackle-receiving aperture therein positionable in coaxial alignment with said body bracket aperture when said cover is installed upon said body.

4. The housing of claim 3 wherein
said bracket means and said plate means, when positioned with said shackle-receiving apertures in coaxial alignment, provide
substantially coplanar surfaces along the lower extremities of said body and said cover, the combination further including
lock protector means comprising
means formed to fit closely about the body and shackle of a padlock having
slot means formed therein providing flat slot end surfaces for cooperative abutment with said substantially coplanar surfaces at substantially equidistant positions relative to the coaxially related apertures, and
means extending about said coaxially related apertures for protection of a padlock shackle positioned therethrough and for retention of said lock protector means in such position by a padlock thus positioned with its shackle through said apertures.

5. The housing of claim 3 wherein
at least two of said sides of said cover extend below said bottom of said housing in positions, so related to said shackle-receiving aperture therein as to limit access to a padlock shackle passed therethrough.

6. The housing of claim 3 including
means in said body for receiving coins inserted thereinto by a consumer,
means in said body for storing coins inserted into said receiving means,
means in said body for releasably receiving a latch means into said body for selective prevention of movement of an external structure relative to said body, and
means in said body intermediate said coin receiving means and said coin storing means for prohibiting removal of coins in said body through said latch receiving means.

7. The housing of claim 6 wherein
said coin storage means includes
further means for prohibiting removal of coins through said latch receiving means.

8. The housing of claim 7 wherein
said further prohibiting means includes
means pivotally mounted in said coin storing means and selectively pivotable between a first, operable position and a second position in sealed relationship with said prohibiting means in said body.

9. The housing of claim 7 wherein
said coin storage means is removable from said body only when said cover is removed therefrom.

10. The housing of claim 6 wherein
said coin storage means includes
means, biased by said cover, for providing close fitting guide surfaces for coins inserted into said coin receiving means.

11. The housing of claim 10 including
means in said body for returning certain coins in said body to a consumer, said guide surface means located so as to direct such coins to said returning means.

12. In a vending machine having a consumer-openable product access door and a latching means attached to said door to prohibit access to the product until the consumer has paid a required sum, the combination of
a housing comprising
a body attachable to said machine for supporting a coin sorting and control mechanism in fixed relationship to said door and its latch means in the closed position of said door, said housing including
means forming three substantially closed and one substantially open side,
means forming an enclosing top and bottom for said body,
means for receiving a latch means attached to said product access door for selectively releasable cooperation with a coin sorting and control means in said body, and
means for receiving coins into said body, for delivery to a coin sorting and control mechanism, when inserted thereinto by a consumer
a cover comprising
means for enclosing said one substantially open side of said body and including a cap plate and a flange,
means for mounting said cover on said body such that said cap plate and flange are received over said top of said body, and
means for fixing said cover to said body with a padlock, and
a coin storage means releasably mounted in said body so as to receive coins thereinto from a coin sorting and control mechanism mounted in said body, and
means in at least one of said body and said coin storage means for preventing removal of coins from the latter through said latch receiving means.

13. The device of claim 12 including
means in said body for returning coins rejected by a coin sorting and control means in said body, including
a coin return opening in said body, means for directing all rejected coins toward said coin return opening, and means on said coin storage means and said cover for cooperation with said directing means to deliver all rejected coins toward said coin return opening.

14. The device of claim 13 wherein said cover and said body each include coaxially relatable padlock shackle receiving means, said cover further including means for restricting access to the shackle of a padlock passed through said receiving means when they are coaxially related.

15. The device of claim 14 including padlock protector means releasably mountable on said cover and said body by a padlock shackle passed through said coaxially related receiving means for restriction access to a padlock shackle which is so mounted.

16. The device of claim 15 wherein said coin removal preventing means comprises baffle means so oriented relative to said latch receiving means as to allow passage of coins from a sorting and control mechanism mounted in said body to said coin storage means but to prevent the passage of coins in the opposite direction.

17. The device of claim 15 wherein said baffle means includes means pivotally movable into a sealing relationship with said baffle means when the vending machine is overturned.

18. The device of claim 13 including means on said coin storage means for biasing cooperating and delivering means into close fitting relationships when said cover is operatively mounted and fixed to said body to prevent movement of coins in said body to any location other than one of said storage means and said coin return opening.

19. A machine for vending a product through a coin-released access door comprising a housing attachable to the machine and lockable against unauthorized access to the interior thereof, means in said housing for receiving coins inserted into said housing and having means for opening said access door and delivering the coins to a coin storage means in said housing when a correct value of coins has been inserted into said housing and means for preventing opening of said access door and for rejecting coins to a coin return slot when an incorrect value of coins has been inserted into said housing, coin storage means in said housing for retaining coins which have been inserted into said housing for opening of said access door, means for preventing unauthorized removal of coins from said coin storage means comprising means fixed in said housing, at least one baffle plate intermediate said coin receiving means and said coin storage means and means pivotally mounting said at least one of said baffle plate for movement thereof into sealing contact with said means fixed in said housing to positively close said coin storage means when said machine is overturned, and said housing including means having a plurality of walls and an upper cap plate and flange and a lower plate-like wall portion forming a cover, a body member forming another part of said housing and receivable in said cover such that the upper end of said body is positioned beneath said cap plate and said flange extends over a portion of said body, said body including a lower plate member alignable with one wall of said cover when said body is received in said cover, each of said lower plate members and said one wall including means to receive a locking device, protection means including a slot which receives said lower plate member and said one wall such that a locking device may be received therein and protected thereby.

20. The machine of claim 18 wherein said preventing means includes means for maintaining said at least one baffle plate in a predetermined position relative to said coin storage means when said machine is upright.

21. The housing of claim 3 including a key-operated locking mechanism in said body which is operable to alter the operating mode of a coin selection and control mechanism within said body;

an opening in said cover which is positioned in aligned relation with said locking mechanism with the cover installed on the body, and indicia on said cover in proximity to said opening with the position of the indicia relative to the locking mechanism indicating the operating mode of the coin selection mechanism.

22. The housing of claim 21 wherein said opening has two straight sides joined together at substantially a right angle and a curved side connected at either of its ends to said straight sides;

said indicia being positioned adjacent said straight sides;

said locking mechanism having a key opening, and the key opening being aligned with one or the other of said indicia in controlling the operating mode of the coin selection and control mechanism to the mode indicated by the indicia aligned with the key opening.

23. A coin selection and control apparatus comprising a coin chute for receiving a plurality of coins in an edge-to-edge straight-line relation;

a first means for contacting the uppermost coin in said straight-line relation to prevent upward movement of the coins within said chute;

a second means for contacting the uppermost coin in said straight-line relation to prevent upward movement of the coins within said chute;

control means to deactivate said first means or said second means such that either the first means or the second means is selected for contact with the coins in said chute;

the first means providing acceptance of a different coin combination by the chute than said second means such that the mode of operation of said apparatus is determined by the means selected by said control means for contact with the coins in the chute;

locking means for actuation of said control means to vary the mode of operation of said apparatus such that the apparatus is locked into a selected mode of operation by the locking means;

said locking means being joined to said control means through a rotatable eccentric whose position is varied by the locking means, a link member having one end connected to said eccentric and a linearly movable control rod having one end connected to said control means and its other end connected to the other end of said link member, and said link member being connected to said linearly movable control rod through a loose connection which permits variation in the angular position of the link member while preserving the linear movement of the movable control rod, whereby the position of the control means is accurately determined by the linear movement of the control rod while the actuation of the control means is determined by the rotational position of said eccentric.

24. The apparatus of claim 23 including indicia positioned relative to said apparatus to indicate the mode of operation of the apparatus through the position of the locking means relative to the indicia.

* * * * *